US005425216A

United States Patent [19]

Ausnit

[11] Patent Number: 5,425,216

[45] Date of Patent: Jun. 20, 1995

[54] METHOD OF MAKING RECLOSABLE PLASTIC BAGS ON A FORM, FILL AND SEAL MACHINE WITH OPEN ZIPPER PROFILES

[75] Inventor: Steven Ausnit, New York, N.Y.

[73] Assignee: Minigrip, Inc., Orangeburg, N.Y.

[21] Appl. No.: 254,239

[22] Filed: Jun. 6, 1994

[51] Int. Cl.[6] ..... B65B 9/20; B65B 61/00; B65B 61/18

[52] U.S. Cl. ..... 53/410; 53/412; 53/451; 53/139.2; 53/551

[58] Field of Search ..... 53/410, 412, 450, 451, 53/139.2, 550, 551, 552

[56] References Cited

U.S. PATENT DOCUMENTS

| | | | |
|---|---|---|---|
| 3,815,317 | 6/1974 | Toss | 53/551 X |
| 4,355,494 | 10/1982 | Tilman | 53/139.2 X |
| 4,601,694 | 7/1986 | Ausnit | 53/139.2 X |
| 4,625,496 | 12/1986 | Ausnit | 53/551 X |
| 4,646,511 | 3/1987 | Boeckmann et al. | 53/551 |
| 4,698,954 | 10/1987 | Behr et al. | 53/551 |
| 4,709,533 | 12/1987 | Ausnit | 53/139.2 X |
| 4,727,709 | 3/1988 | Zieke et al. | 53/551 |
| 4,790,126 | 12/1988 | Boeckmann | 53/139.2 X |
| 4,829,745 | 5/1989 | Behr et al. | 53/451 |
| 4,840,012 | 6/1989 | Boeckmann | 53/139.2 X |
| 4,869,048 | 9/1989 | Boeckmann | 53/551 X |
| 4,876,842 | 10/1989 | Ausnit | 53/139.2 X |
| 4,894,975 | 1/1990 | Ausnit | 53/551 X |
| 4,909,017 | 3/1990 | McMahon et al. | 53/551 X |
| 4,941,307 | 7/1990 | Wojcik | 53/139.2 X |
| 4,993,212 | 2/1991 | Veoukas | 53/551 X |
| 5,027,584 | 7/1991 | McMahon et al. | 53/551 X |
| 5,042,224 | 8/1991 | McMahon | 53/139.2 X |
| 5,072,571 | 12/1991 | Boeckmann | 53/139.2 X |
| 5,127,208 | 7/1992 | Custer et al. | 53/139.2 X |

*Primary Examiner*—Horace M. Culver
*Attorney, Agent, or Firm*—Kane, Dalsimer, Sullivan, Kurucz, Levy, Eisele and Richard

[57] ABSTRACT

In a method for forming reclosable packages on a conventional form-fill-and-seal (FFS) machines, first and second interlocking members are fed toward and longitudinally parallel to the filling tube thereof in an uninterlocked condition. A thermoplastic film is wrapped around the filling tube enclosing the first and second interlocking members, and the lateral edges of the film are bonded together to form a longitudinal seam. At least one of the first and second interlocking members is attached by a heat sealing bar to the inside of the tube so formed from the thermoplastic film. A fold is formed in the tube between the first and second interlocking members to bring the members into a facing relationship, and the members are then interlocked with one another. At intervals, transverse seams are formed to produce individual reclosable packages, which may also be separated from one another. The packages are filled with product during the course of their manufacture. The filling tube may taper inwardly so that the fold can be formed and the interlocking members interlocked as a space of increasing width forms between a forming guide and the inwardly tapering filling tube.

25 Claims, 10 Drawing Sheets

METHOD OF MAKING RECLOSABLE PLASTIC BAGS ON A FORM, FILL AND SEAL MACHINE WITH OPEN ZIPPER PROFILES

BACKGROUND OF THE INVENTION

1. Field of The Invention

The present invention relates to improvements in the manufacturing of reclosable plastic bags, and, more particularly, to a method which permits such bags to be formed as they are fed over a filling spout of a filling machine whereby the bags are formed and simultaneously filled with a product.

2. Description of the Prior Art

The art of making reclosable plastic bags provided with mating profiles which form a zipper to render the bags reclosable is well-defined in prior patents. Examples of such patents are U.S. Pat. Nos. 4,709,533; 4,894,975; and 5,046,300.

U.S. Pat. No. 4,709,533 shows an apparatus and a method wherein film is fed downwardly wrapped around a form-fill tube and the edges of the film are brought together pressed between pressing rollers guiding the edges together so that an outer seal can be formed. Means are provided for feeding interlocked zipper members between the film layers and between the rollers and the filling spout. Following the rollers, there are located uniquely positioned and shaped bars which include inner bars that have a space between them to guide the center portion of the zipper and these bars also form a backing for outer heated bars which seal the webs of the zipper to the inner surface of the bag film. The outer bars also extend around the edges of the bag to simultaneously form an outer security seal or lip seal. The thus formed and sealed zipper tube is filled through the spout and cross-seals with cross-cutters to complete the individual bags.

U.S. Pat. No. 4,894,975 also shows an apparatus and method wherein film is fed downwardly wrapped around a form-fill tube and the edges of the film are brought together in adjacency. The adjacent edges of the film are joined such as by heat sealing to interlocked zipper members, which thereafter form the sole juncture between the edges of the film and which zipper members provide a reclosable opening for the top of the completed bag. A web extends between the zipper strips, either above or below the interlocking elements, which web can be constructed of a weight and width with optimum characteristics for forming a security seal at the top of the bag and forming a tamper-evident seal. In a single rapid operation, a bag is formed wherein the film of the bag has optimum characteristics for the bag, and the plastic of the zipper and of the web therebetween have optimum characteristics for the functions of the zipper and functions of the security tamper-evident seal. The thus formed and sealed zipper tube is filled through the spout and cross-sealed with cross-cutters to complete the individual bags.

U.S. Pat. No. 5,046,300 shows a method and apparatus for forming reclosable packages wherein a flat packaging film is formed over a forming shoulder and into a tubular shape about a central member. The packaging film is advanced vertically downward along the length of the central member, and a reclosable profile element is threaded inside the tubular shape of the packaging film. The tubular packaging film is deformed to form a longitudinally extending loop of packaging film, and the interlocked zipper members are guided into the loop.

The interlocked zipper members are then adhered to the inner surface of the loop of packaging film. The thus formed and sealed zipper tube is filled through the spout and cross-sealed with cross-cutters to complete the individual bags. It should be noted, that in each of the above described prior art methods some portion of the film is drawn away from the fill tube at substantially a right angle to the fill tube to receive and be sealed to the zipper strips. This additional film causes a problem of potential wrinkling of the film at the cross seal locations.

U.S. patent application Ser. No. 08/226,288, filed on Apr. 11, 1994 and commonly assigned, shows a method for forming reclosable packages on a conventional form-fill-and-seal (FFS) machine, wherein a "Y-type" zipper strip having closed profiles is fed toward and longitudinally down the filling spout thereof. A thermoplastic film is wrapped around the filling spout enclosing the zipper strip, and the lateral edges of the film are bonded together to form a longitudinal seam. The zipper strip webs are attached by sealing bars to the inside of the tube so formed from the thermoplastic film between the fill tube and the sealing bars. At intervals, transverse seams are formed to produce individual reclosable packages, which may also be separated from one another. The packages are filled with product during the course of their manufacture. In all of the above mentioned inventions the zipper strip is always delivered to the fill tube in interlocked condition.

The present invention represents an alternate approach toward the attachment of reclosable profile elements to a tubular packaging film, and toward the formation of reclosable plastic bags containing a product, wherein the profile elements are enclosed within a tube of thermoplastic film and attached to the inner surface thereof on the fill tube of a form-fill-and-seal machine in an uninterlocked condition. This method provides a number of advantages. It minimizes the likelihood of the formation of wrinkles in the film in the cross seal area and allows different zipper constructions to be relatively easily interchanged in the form-fill-and-seal machine.

SUMMARY OF THE INVENTION

Accordingly, in its broadest form, the present invention is a method for forming reclosable packages from a sheet of thermoplastic film on a form-fill-and-seal (FFS) machine, wherein a continuous supply of zipper strip having first and second interlocking members is fed toward and guided longitudinally parallel to the filling tube thereof in an uninterlocked condition.

A continuous supply of thermoplastic film is also fed toward the filling tube, and is wrapped therearound enclosing the first and second interlocking members within the tube so formed. The lateral edges of the thermoplastic film are sealed together with a longitudinal seam to close the tube at a point away from the zipper location.

At least one of the first and second interlocking members is attached to the inside of the tube of thermoplastic film by sealing, bonding or welding, and a fold is formed in said tube to bring the first and second interlocking members into a facing relationship. The interlocking members are then interlocked with one another.

Thereafter, periodically along the length of the tube, transverse seams are formed to produce individual reclosable packages, which are separated from one another.

The present invention will now be described in more complete detail with reference frequently being made to the figures identified as set forth below.

DETAILED DESCRIPTION OF THE PREFERRED EMBODIMENTS

Figure 1:
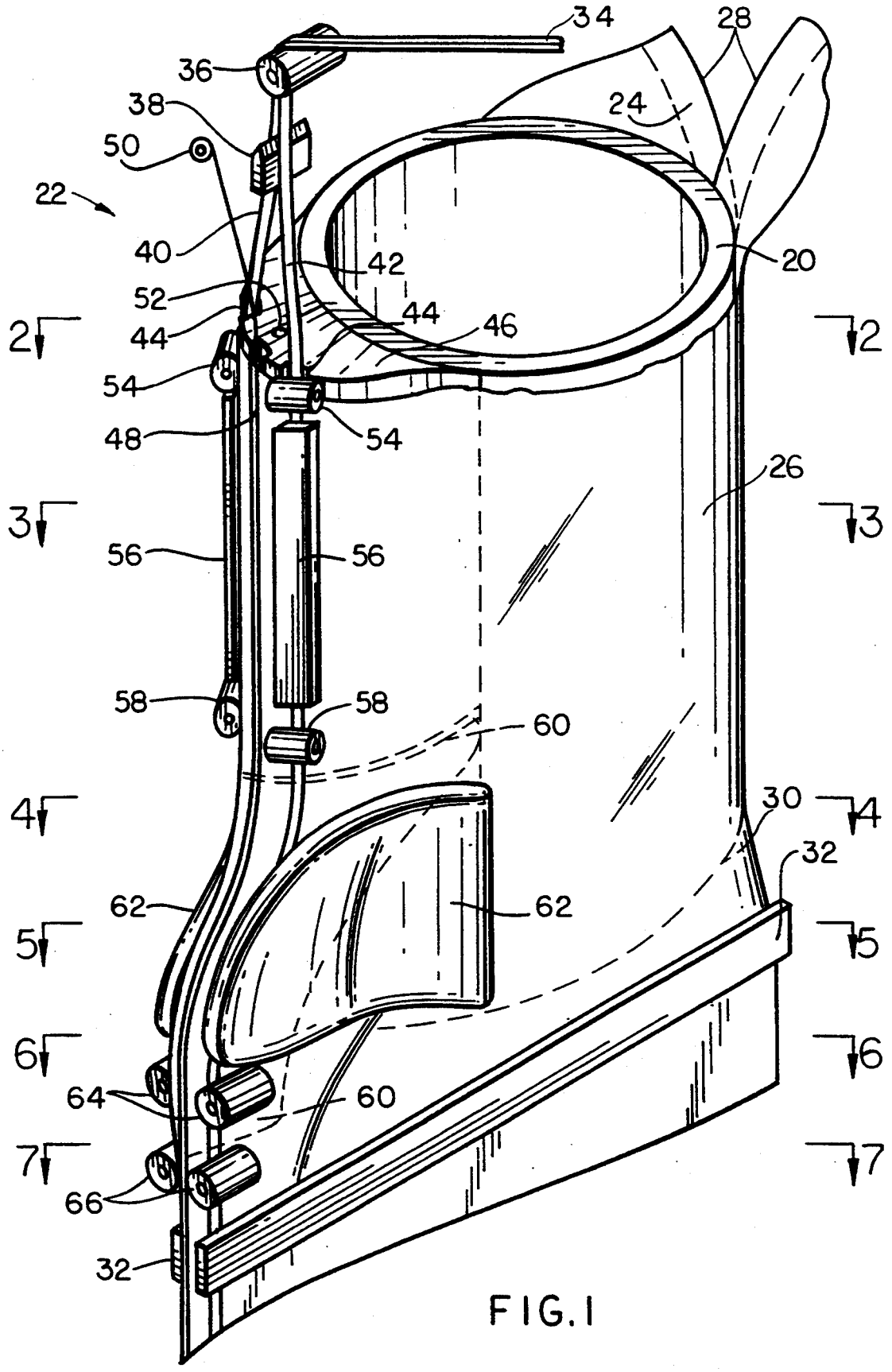
FIG. 1 is a perspective view of the filling tube of a conventional form-fill-and-seal (FFS) machine adapted to the practice of the present invention.

Reference is now made to the drawings, and to FIG. 1 in particular, wherein the filling tube 20 of a conventional vertical form-fill-and-seal (FFS) machine 22 is depicted. In the customary manner, a continuous supply of a film 24 is brought from a supply roll about suitable guides to be wrapped into a tube 26 about the filling tube 20. As the film 24 passes around the filling tube 20, the lateral edges 28 thereof are overlapped and a longitudinal seam is formed by a heat sealing bar, behind the filling tube 20 and not visible in the figure, in a manner that is well known to those of ordinary skill in the art, so as to transform the film 24 into a tube 26 about the filling tube 20. As the tube 26 is advanced in stepwise fashion down in the filling tube 20 in increments equal to the width of the bags being produced, it is flattened below the bottom 30 thereof. Transverse seams 24 are formed by heat sealing bars 32, which seal the bottom of the tube 26, as well as the top of the bag made immediately therebefore, following each incremental advance thereof. A predetermined quantity of product (not shown) is dropped through the filling tube 20 following each production of a transverse seam by heat sealing bars 32. The heat sealing bars 32 also separate each filled and sealed bag from the bottom of the tube 26.

In accordance with the present invention, a zipper strip 34 is fed from a supply roll (not shown) and around a guide roller 36, below which may be a zipper separator 38, a disengaging and if required also a cutting instrument which separates the zipper strip 34 longitudinally into two portions, which may be a male profile 40 and a female profile 42, but which in general are two mutually interlockable profiles.

The male profile 40 and female profile 42 are each guided into longitudinal grooves 44, which are cut into the surface of a curved plate 46 attached to the filling tube 20, within the tube 26 formed by film 24. An intermediate groove 44, between those provided for the male profile 40 and the female profile 42, may be provided for a tear string 48, which may be introduced from a spool 50.

The zipper strip 34 and tear string 48 may be formed of a thermoplastic material, such as polyethylene. Similarly, for many products, the film 24 may be of polyethylene or of a similar thermoplastic material, so that the zipper strip 34 material and tear string 48 may be heat-bonded thereto. Alternatively, the tear string 48 may be formed of string or of some other material encased in polyethylene.

Figure 2:
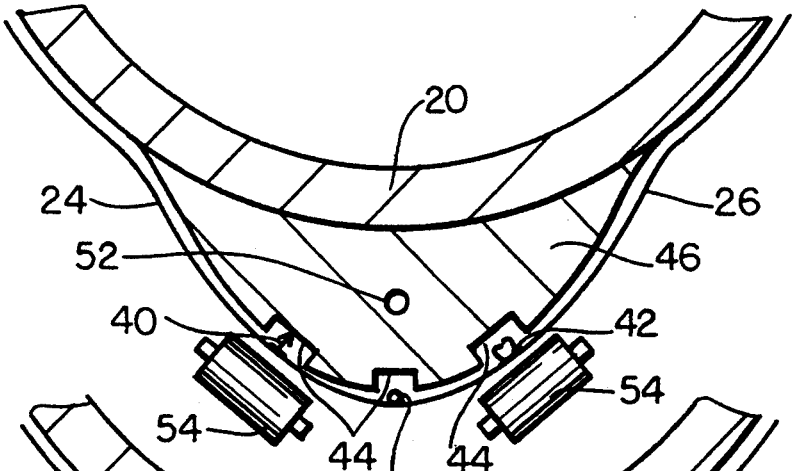
FIG. 2 is a cross-sectional view taken as indicated by line 2—2 in FIG. 1.

FIG. 2 is a cross section of the FFS machine 22 taken as indicated by line 2—2 in FIG. 1. Curved plate 46, in addition to longitudinal grooves 44, may be provided with a hot air channel 52, which, as will be later indicated, may discharge bursts of hot air between the profiles 40, 42 to soften them at points where heat sealing bars 32 will subsequently make a transverse seam across them, or may discharge a continuous stream of hot air onto the entire profiles 40, 42, as is described in copending patent applications U.S. Ser. No. 039,644 and U.S. Ser. No. 065,668 respectively. In either case, the hot air may be applied at the point where the profiles 40, 42 will be interlocked with one another.

Longitudinal grooves 44 are provided to guide male profile 40, female profile 42 and tear string 48 on the inside of the tube 26 of film 24. Guide rolls 54 ensure that male profile 40 and female profile 42 remain within their respective longitudinal grooves 44.

Figure 3:
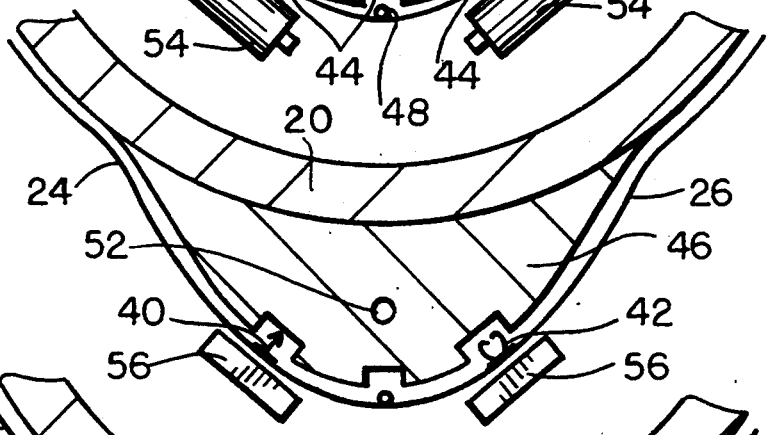
FIG. 3 is a cross-sectional view taken as indicated by line 3—3 in FIG. 1.

FIG. 3 is a cross section of the FFS machine 22 taken as indicated by line 3—3 in FIG. 1. Heat sealing bars 56 seal, bond, or weld the male profile 40 and the female profile 42 to the inside surface of the tube 26 of film 24. If necessary, another heat sealing bar may be used to attach the tear string 48 to the tube 26.

Referring back to FIG. 1, an additional pair of guide rolls 58 may be provided below heat sealing bars 56 on the FFS machine 22 to ensure that the male profile 40 and the female profile 42 remain guided within longitudinal grooves 44.

Below curved plate 46 and guide rolls 58, and within tube 26 of film 24 on the filling tube 20 is a forming plate 60 whose purpose is to gradually fold the film 24 in the vicinity of the male profile 40 and female profile 42 to permit the profiles 40, 42 to be interlocked with one another. Adjacent to forming plate 60, but outside the tube 26 of film 24 are a pair of forming shields 62, which hold the film 24 against the forming plate 60 to permit the folding operation to proceed smoothly.

Figure 4:
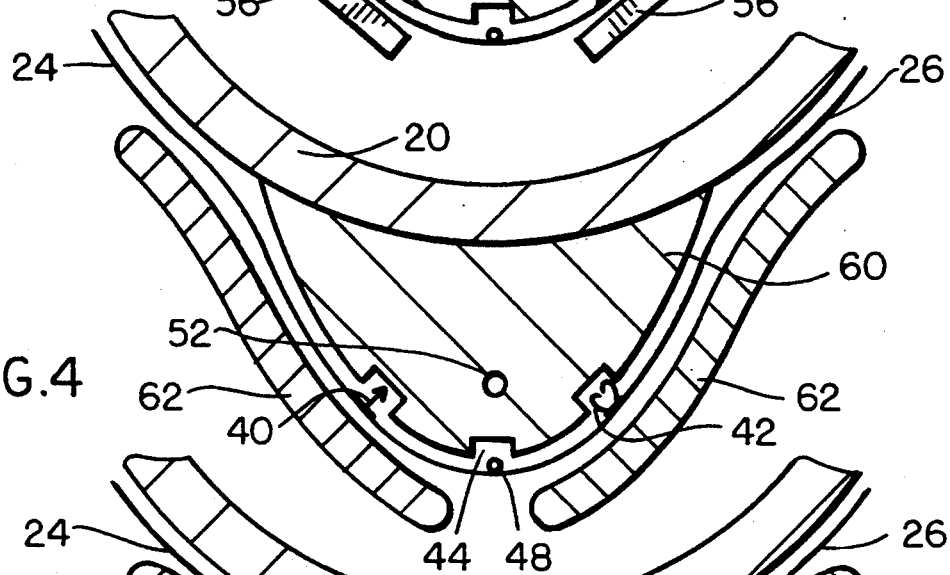
FIG. 4 is a cross-sectional view taken as indicated by line 4—4 in FIG. 1.

FIG. 4 is a cross section of the FFS machine 22 taken as indicated by line 4—4 in FIG. 1. As may be observed, hot air channel 52 continues from curved plate 46 into forming plate 60. The tube 26 of film 24 proceeds downward through the space between the forming plate 60 and the forming shields 62. Longitudinal grooves 44 continue from the curved plate 46 to the forming plate 60 to guide the male profile 40, the female profile 42 and the tear string 48.

Figure 5:
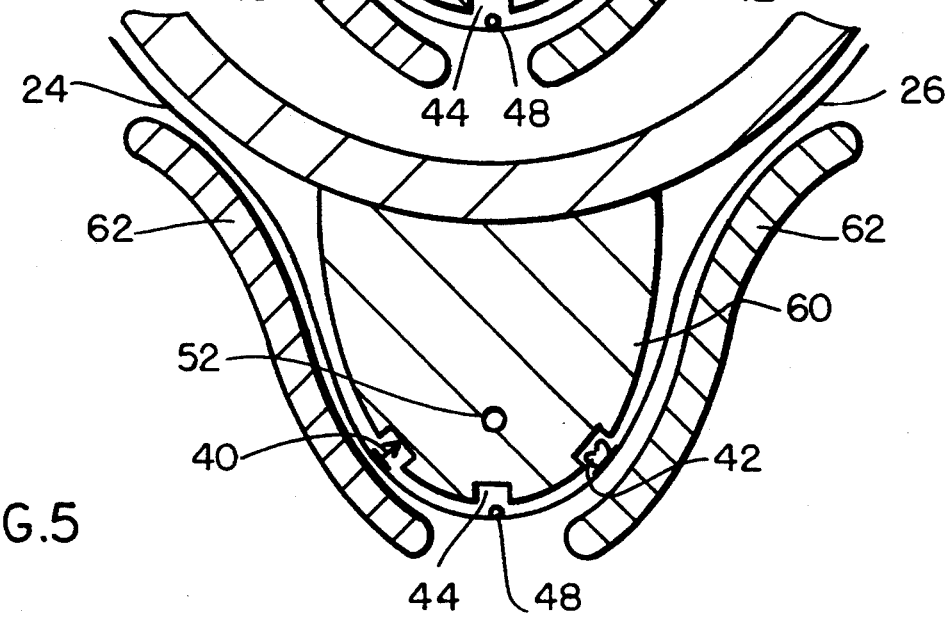
FIG. 5 is a cross-sectional view taken as indicated by line 5—5 in FIG. 1.
Figure 6:
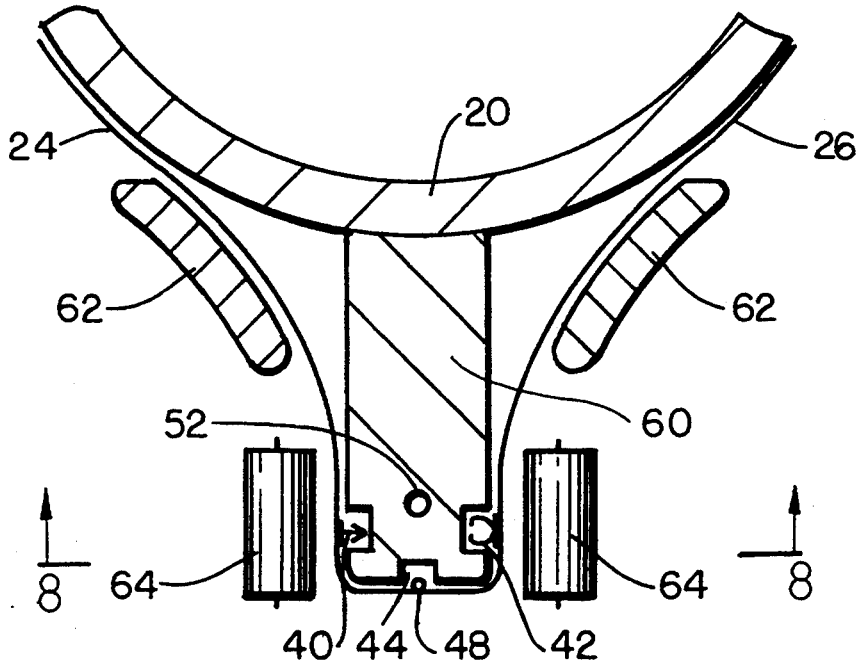
FIG. 6 is a cross-section view taken as indicated by line 6—6 in FIG. 1.

FIGS. 5 and 6 are cross sections of the FFS machine 22 taken as indicated by lines 5—5 and 6—6, respectively, in FIG. 1. As will be apparent in viewing FIGS. 3 through 6 sequentially, the cross-sectional shape of the curved plate 46 is different from that of the forming plate 60, and the cross-sectional shape of the forming plate 60 gradually changes from one identical to the curved plate 46 to the thin finger shape, wherein the male profile 40 and female profile 42 face each other, shown in FIG. 6. It will be apparent to one of ordinary skill in the art that the circumference measured around the filling tube 20 and curved plate 46 or forming plate 60 at all points longitudinally along the FFS machine 22 must be substantially the same, so that the film 24 may be neither stretched nor folded any more than is necessary to interlock male profile 40 and female profile 42, as it is conveyed therealong in the form of tube 26.

Referring to FIGS. 1 and 6, still another pair of guide rolls 64 may be disposed at the bottom of the forming plate 60 to ensure that male profile 40 and female profile 42 are maintained in their respective longitudinal grooves 44 and facing one another, so that they will be in a position to be interlocked with one another below the forming plate 60.

Figure 7:
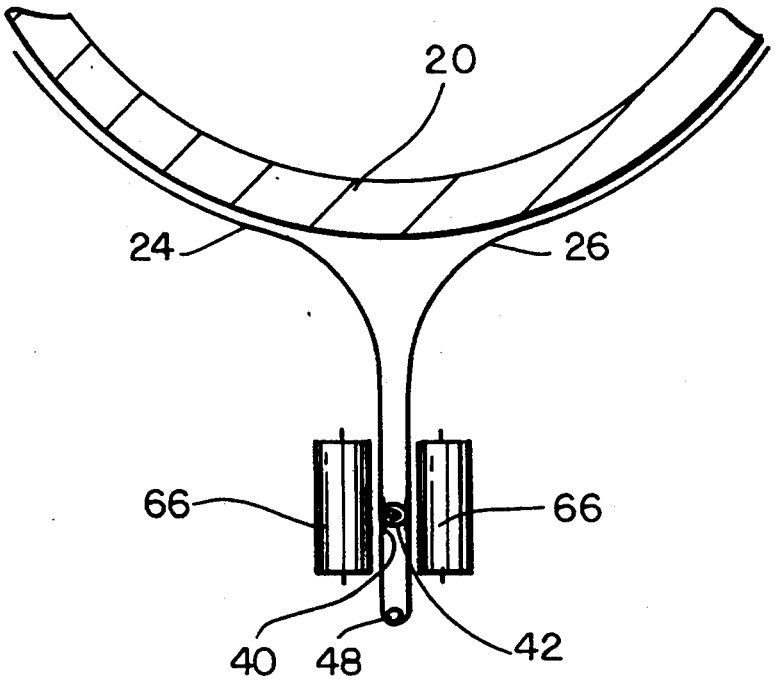
FIG. 7 is cross-sectional view taken as indicated by line 7—7 in FIG. 1.

Finally, FIG. 7 is a cross section of the FFS machine 22 taken as indicated by line 7—7 in FIG. 1 below the forming pate 60. There, closing rolls 66 interlock male profile 40 into female profile 42.

Figure 8:
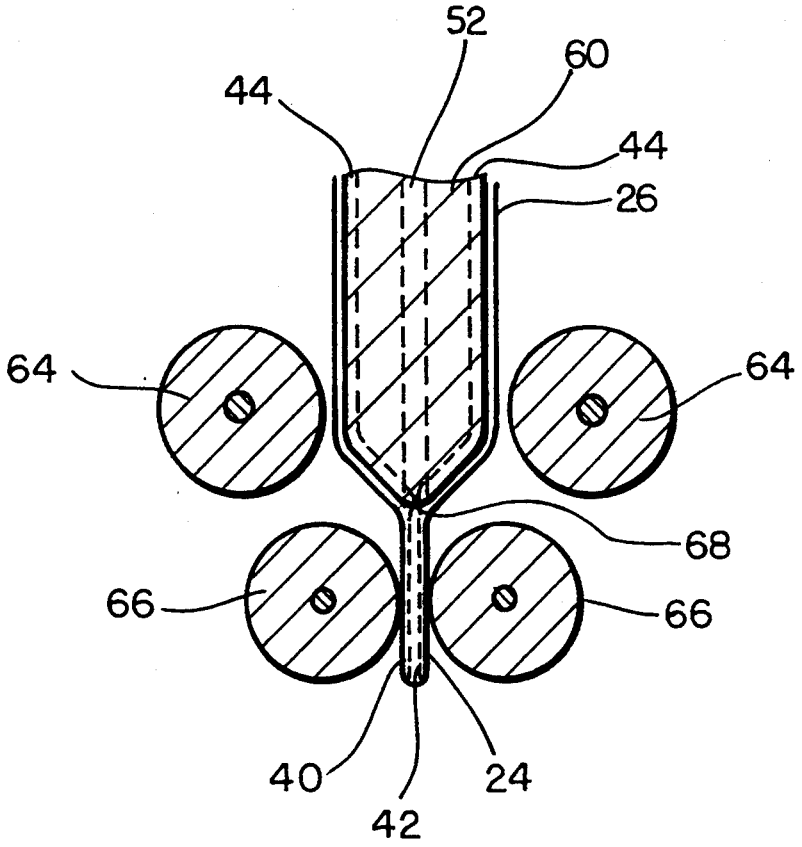
FIG. 8 is a cross-sectional view taken as indicated by line 8—8 in FIG. 6.

FIG. 8 is a cross section taken as indicated by line 8—8 in FIG. 6. At the bottom of forming plate 60, guide rolls 64 ensure that male profile 40 and female profile 42 stay in their respective longitudinal grooves 44 on opposite sides of the forming plate 60. Below guide rolls 64, the forming plate 60 tapers and longitudinal grooves 44 merge into one another at the tapered end 68 to permit the male profile 40 to be inserted into the female profile 42. Hot air channel 52 also ends at the tapered end 68, so that hot air blasts may be directed onto the inside of profiles 40, 42 to soften them, as may be required, at the locations of transverse seams, to be provided subsequently by heat seal bars 32, or so that a stream of hot air may be continuously supplied to soften the profiles 40, 42. Closing rolls 66 interlock the profiles 40, 42.

Heretofore, the present discussion has illustrated the use of string profiles, that is, male profile 40 and female profile 42 having no webs, either short or long, attached thereto. The present invention can be adapted for the use of profiles having webs, and of profiles which are joined to each other by a central web. Referring again to FIG. 1, the use of a zipper strip 34 having a central or peripheral webs would permit the present invention to be adapted for the use of profiles having long (wide) or short (narrow) webs. In the event a central web zipper is used, the zipper may be delivered open, in which case the separator 38 would not be required.

Figure 9:
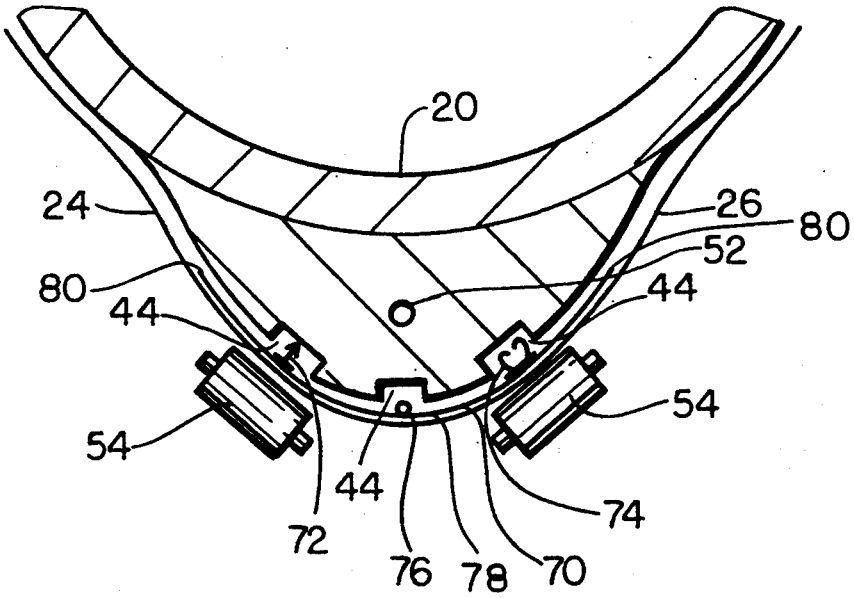
FIG. 9 is a cross-sectional view, analogous to that provided in FIG. 2, for an alternate embodiment of the present invention.

Referring to FIG. 9, which is analogous to FIG. 2, a closure 70 includes a male profile member 72, a female profile member 74, a tear string 76, a central web 78, and two peripheral webs 80. Closure 70 may be introduced into FFS machine 22 instead of zipper strip 34, and, if in an open configuration with the removal of zipper separator 38, may be used in the practice of the present invention.

Figure 10:
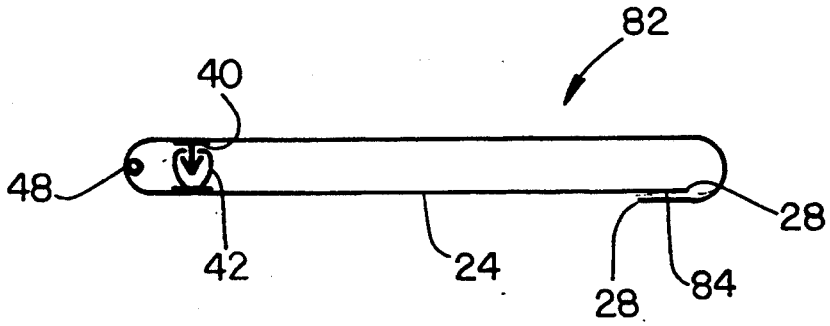
FIG. 10 is a cross-sectional view of a bag made in accordance with a preferred embodiment of the present invention.

FIG. 10 is a cross section of a bag 82 made in accordance with the present invention. Male profile 40 and female profile 42 are so-called string profiles having webs of minimal size. Tear string 48 is disposed in the fold between the male profile 40 and female profile 42. A longitudinal seam 84 is formed where the lateral edges 28 of the film 24 are overlapped and bonded, welded or otherwise sealed together.

Figure 11:
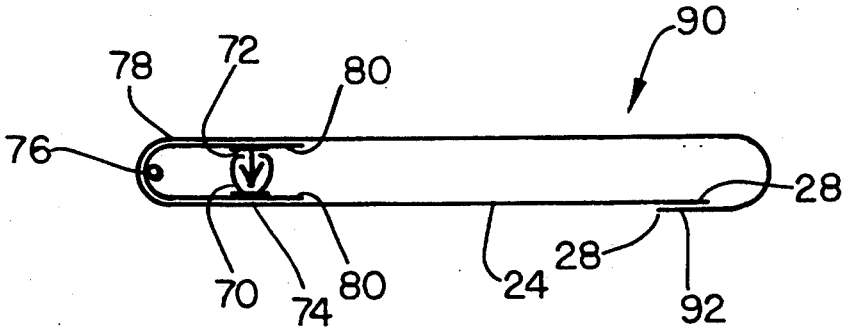
FIG. 11 is a cross-sectional view of a bag made in accordance with the alternate embodiment of the present invention shown in FIG. 9.

By way of contrast, FIG. 11 is a cross section of a bag 90 made using closure 70, previously shown above in FIG. 9. As before, the lateral edges 28 of film 24 are attached to one another to form longitudinal seam 92. Closure 70, having male profile member 72, female profile member 74, tear string 76, central web 78 and peripheral webs 80, is bonded to the inside of the film 24.

Figure 12:
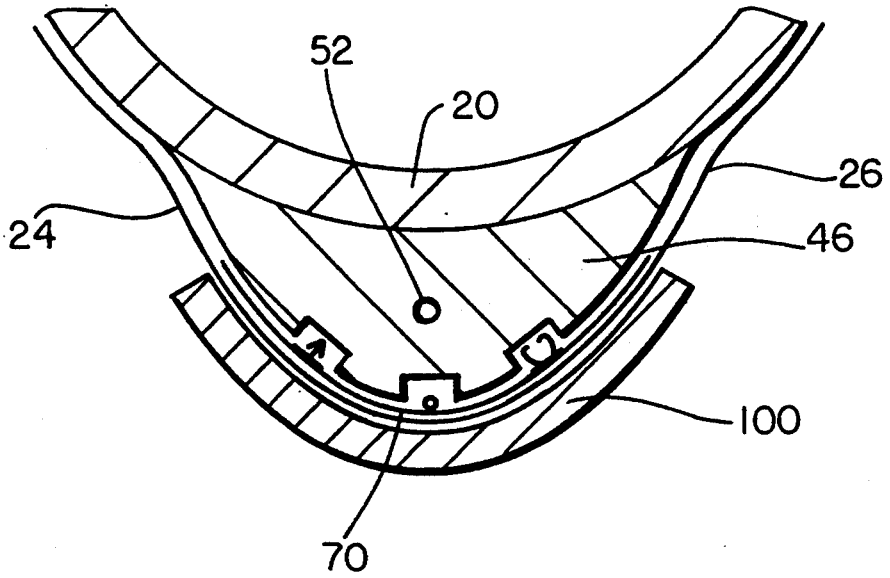
FIG. 12 is a cross-sectional view, analogous to that provided in FIG. 3, of the FFS machine used to manufacture the bag shown in FIG. 11.

The bonding of closure 70 to the inside of tube 26 of film 24 may be accomplished in the manner shown in FIG. 12, which is a cross section of the FFS machine 22 analogous to FIG. 3. It will be noted, when comparing FIG. 12 to that earlier figure, that heat sealing bar 100, spanning the entire width of closure 70, has been substituted for the pair of heat sealing bars 56.

Figure 13:
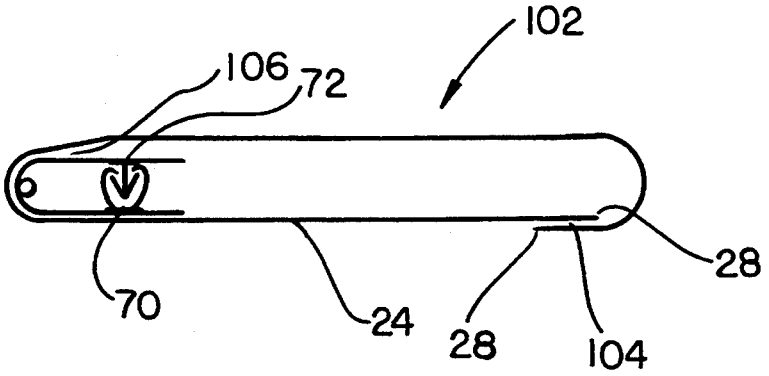
FIG. 13 is a cross-sectional view of a bag made in accordance with yet another embodiment of the present invention.
Figure 14:
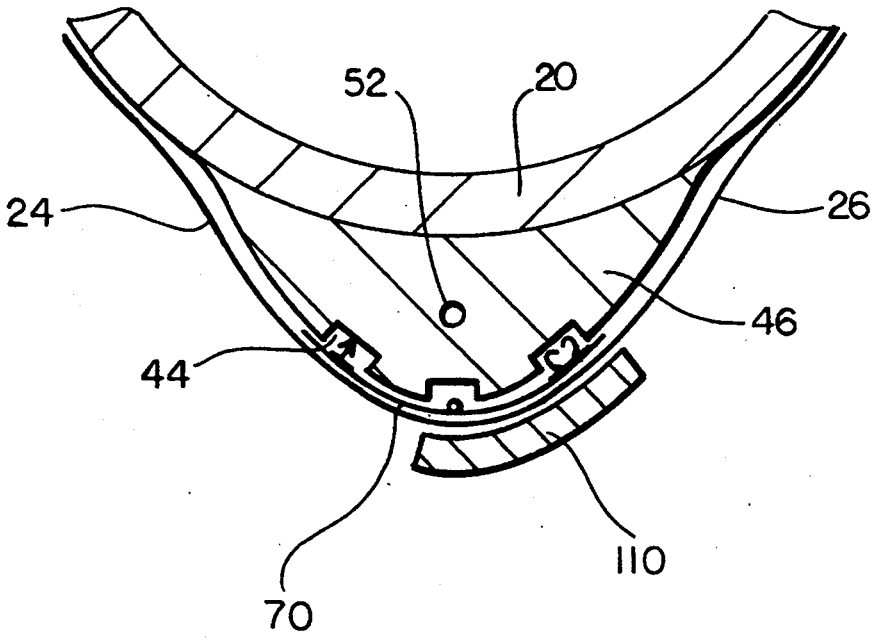
FIG. 14 is a cross-sectional view, analogous to that provided in FIGS. 3 and 12, of the FFS machine used to manufacture the bag shown in FIG. 13.

A variation on the use of closure 70 is illustrated in FIGS. 13 and 14, the former of which is a cross section of a bag 102 wherein only a portion of closure 70 is sealed to the inside of film 24.

More specifically, referring now to FIG. 14, which is a cross section of the FFS machine 22 analogous to that provided in FIGS. 3 and 12, the bonding of closure 70 to the inside of tube 26 of film 24 may be carried out for somewhat less than the width of closure 70. This leaves a portion of central web 78, in this instance that portion having male profile portion 72, unbonded to the film 24. As a consequence, bag 102 will be provided with a hinge 106 between film 24 and the unbonded portion of profile 70. Longitudinal seam 104 is formed where the lateral edges 28 of film 24 are welded to one another.

Figure 15:
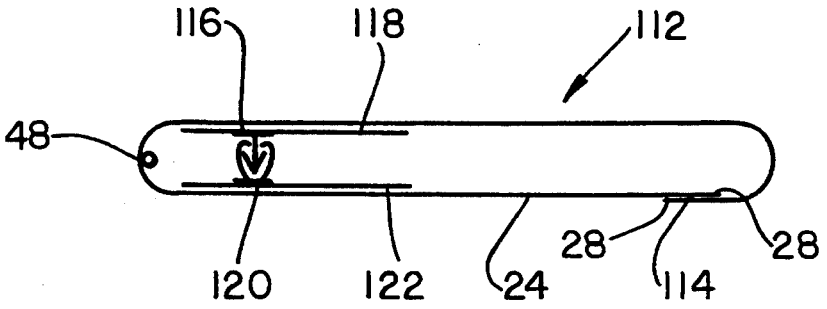
FIG. 15 is a cross-sectional view of still another bag made in accordance with the present invention.

FIG. 15 is a cross section of a bag 112 made in accordance with yet another embodiment of the present invention. Bag 112 has a male profile 116 with an adjacent web 118 and a female profile 120 with an adjacent web 122. Male and female profiles 116, 120 with their respective webs 118, 122 may be provided initially in the form of a strip analogous to zipper strip 34 previously shown. Male and female profiles 116, 120 may be adjacent to each other on such a strip, or may be separated by a central web. Ultimately, depending upon which these options is taken, the webs 118, 122 will be as shown in FIG. 15 farther from tear string 48 than male and female profiles 116, 120, or closer to the tear string 48 than the profiles 116, 120. As before, longitudinal seam 114 is formed where lateral edges 28 of film 24 are overlapped and sealed to one another.

Figure 16:
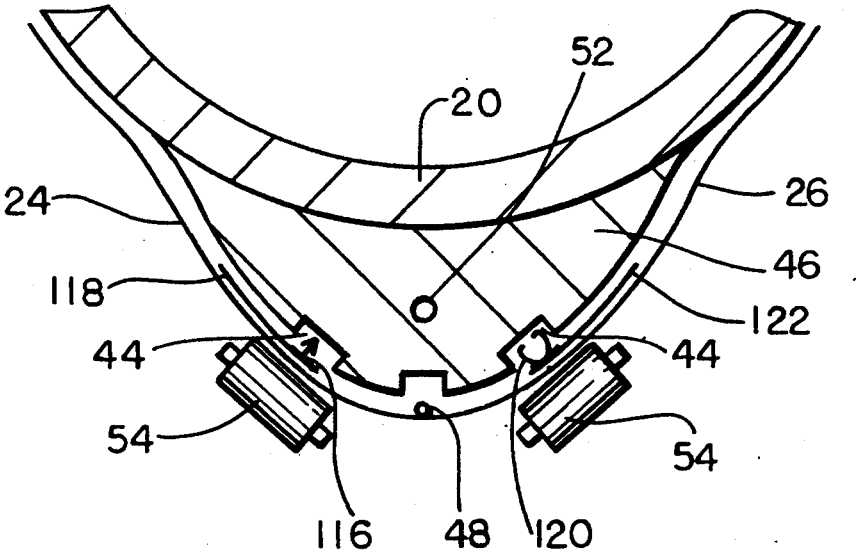
FIG. 16 is a cross-sectional view, analogous to that provided in FIGS. 2 and 9, of the FFS machine used to manufacture the bag shown in FIG. 15.

FIG. 16 is a cross section of FFS machine 22, analogous to FIGS. 2 and 9, where bags 112 of FIG. 15 are being produced. Male profile 116 with adjacent web 118 and female profile 120 with adjacent web 122 are guided in grooves 44 in curved plate 46. Male and female profiles 116, 120 may initially have been part of a single zipper strip, like zipper strip 34 in FIG. 1 but having additional webs 118, 122, wherein the single zipper strip was cut longitudinally by zipper by a cutter located at separator 38. As suggested above, on such a zipper strip male profile 116 and female profile 120 may be adjacent to one another, webs 118, 122 being on the peripheral sides of the strip, to produce the configuration shown in FIG. 16, or male and female profiles 116, 120 may be separated by a central web, which, when cut longitudinally, produces webs 118, 122. Alternatively profiles 116 and 120 with their respective webs may be delivered in joined configuration and disengaged by separator 38.

Figure 17:
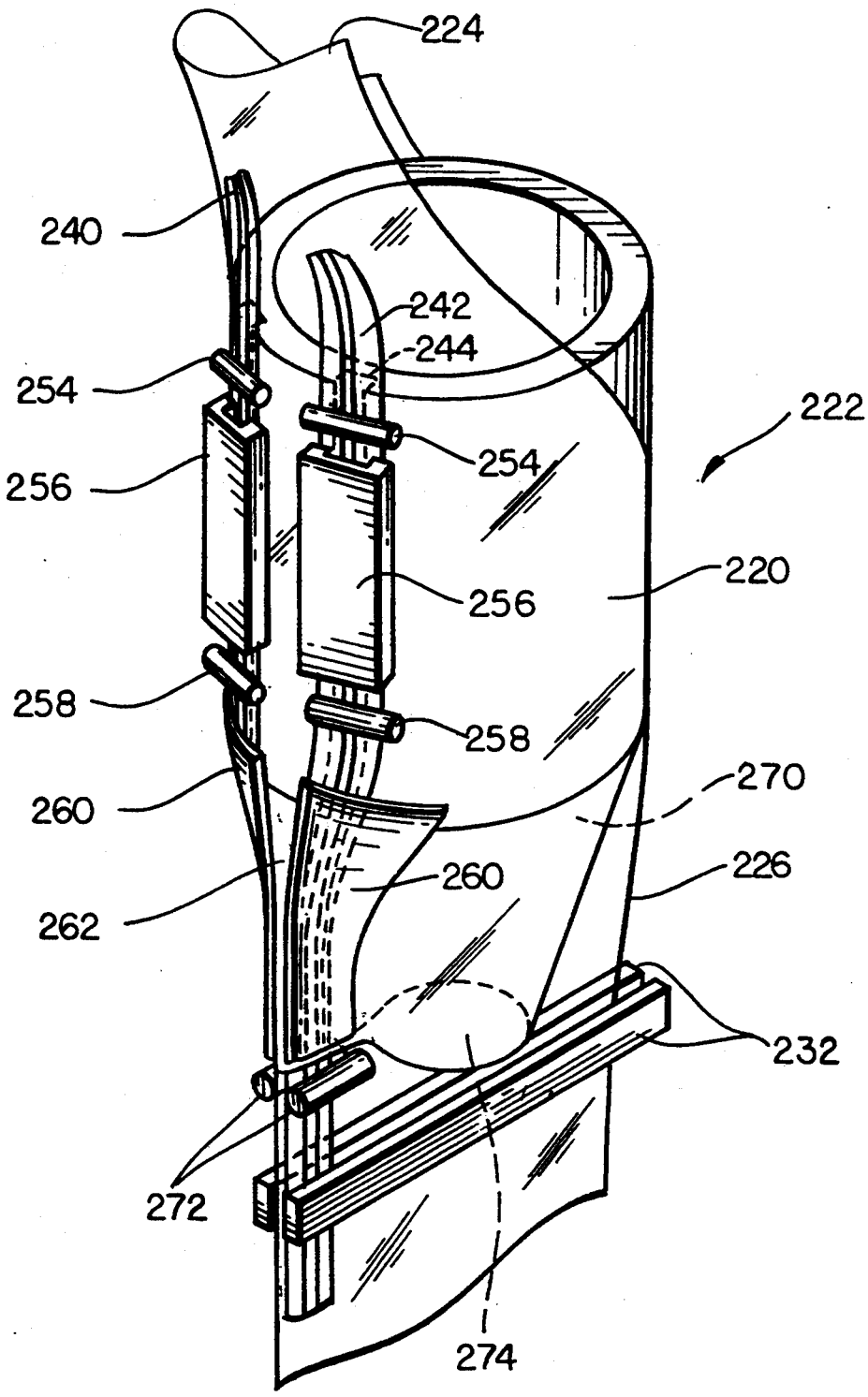
FIG. 17 is a perspective view analogous to FIG. 1 of yet another alterative embodiment of the present invention in which a modified filling tube is utilized in the FFS machine.
Figure 18:
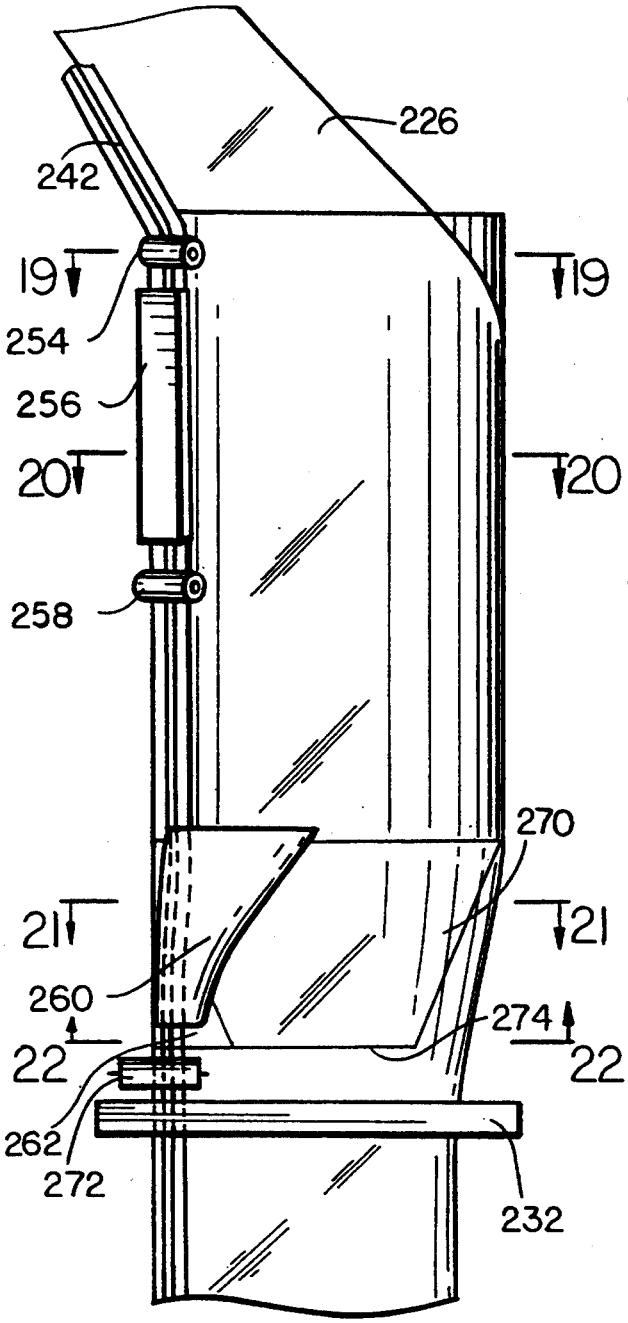
FIG. 18 is a side elevational view of the FFS machine of FIG. 17.
Figure 19:
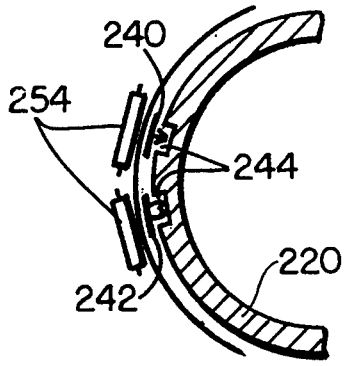
FIG. 19 is a cross-sectional view taken as indicated by lines 19—19 of FIG. 18.
Figure 20:
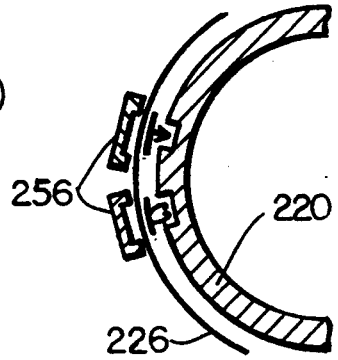
FIG. 20 is a cross-sectional view taken as indicated by lines 20—20 of FIG. 18.
Figure 21:
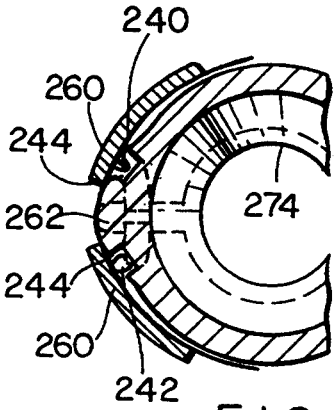
FIG. 21 is a cross-sectional view taken as indicated by lines 21—21 of FIG. 18.
Figure 22:
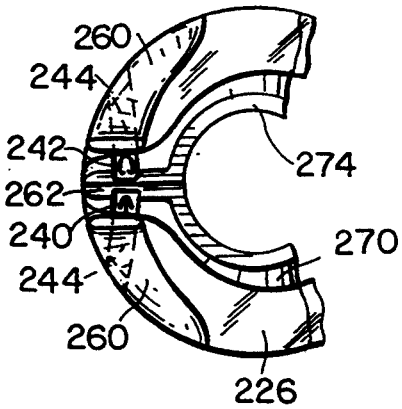
FIG. 22 is a cross-sectional view taken as indicated by lines 22—22 of FIG. 18.

Reference is now made to FIG. 17 in which like components bear the same reference numeral as previously used increased by 200. Thus, film 224 is depicted being wrapped about fill tube 220 of FFS machine 222 to form tube 226 in the manner previously described. The tube 226 is filled with product and sealed into bags by sealing bars 232. As before uninterlocked male profile 240 and 242 are guided into longitudinal grooves 244 which are cut into fill tube 220 (or may be formed in a plate attached to the fill tube). As before an additional groove for a tear string may also be provided. Guide rolls 254 ensure that the male profile 240 and female profile 242 remain within their respective grooves 244 as shown in FIG. 19 and heat sealing bars 256 bond or weld the profiles 240, 242 to the inside surface of the film tube 226. An additional guide roll 258 ensures that the profiles 240, 242 remain in their respective grooves 244 after being attached to the film.

The present embodiment of the invention as shown in FIGS. 17 through 22 differs from previously described in that the fill tube 220 tapers inwardly into a funnel shape 270 with the area adjacent the profiles gradually forming a finger 262 protruding from said funnel the groove 224 are continued into this finger. A pair of forming shields 260 are provided below guide rolls 258 and extend to the lower end 274 of the fill tube 220. The profiles are kept within the grooves 244 by said forming shields. At the lower end 274 of the fill tube, the grooves in the finger 262 have positioned the profiles in facing relationship, so that a pair of closing rolls 272, just below the end of the finger, press the profiles together into interlocking relationship. Thereafter the tube is sealed and cut by cross bars 232 in the manner previously discussed.

Modifications to the above would be obvious to those of ordinary skill in the art, and would not bring the invention so modified beyond the scope of the appended claims.

What is claimed is:

1. A method for forming reclosable packages from a sheet of thermoplastic film on a form-fill-and-seal machine comprising the steps of:

feeding a continuous supply of zipper strip having first and second interlocking members toward a filling tube of said form-fill-and-seal machine, said first and second interlocking members not being interlocked with one another;

guiding said first and second interlocking members longitudinally in a direction parallel to said filling tube;

feeding a continuous supply of said thermoplastic film having two lateral edges toward said filling tube;

wrapping said thermoplastic film about said filling tube and about said first and second interlocking members;

forming a longitudinal seam in said thermoplastic film by sealing said two lateral edges to one another to produce a tube enclosing said first and second interlocking members and said filling tube;

attaching at least one of said first and second interlocking members to said thermoplastic film on an inside surface of said tube;

forming a fold in said tube of thermoplastic film between said interlocking members and bringing said first and second interlocking members into a facing relationship;

interlocking said first and second interlocking members with one another;

periodically forming a transverse seam across said tube to produce individual reclosable packages; and separating said individual reclosable packages from one another.

2. The method as claimed in claim 1 further comprising the step of filling said reclosable plastic bags with a product by delivering said product through said filling tube, said filling step alternating with said step of forming a transverse seam.

3. The method as claimed in claim 1 further comprising the step of feeding a continuous supply of tear string between said filling tube and said thermoplastic film in a space between said first and second interlocking members.

4. The method as claimed in claim 1 further comprising the steps of directing a stream of hot air onto said first and second interlocking members prior to said interlocking step.

5. The method as claimed in claim 1 further comprising the step of periodically directing a blast of hot air onto said first and second interlocking members prior to said interlocking step.

6. The method as claimed in claim 1 wherein said first and second interlocking members are a male profile and a female profile.

7. The method as claimed in claim 1 wherein said guiding step is performed by disposing said first and second interlocking members in grooves directed longitudinally in a direction parallel to said filling tube.

8. The method as claimed in claim 7 wherein said grooves are provided in a curved plate attached to said filling tube.

9. The method as claimed in claim 8 wherein said grooves in said curved plates are continued by grooves on a forming plate that brings said interlocking members into facing relationship.

10. The method as claimed in claim 9 wherein said thermoplastic film is maintained in close relationship with said forming plate by forming shields.

11. The method as claimed in claim 1 wherein said zipper strip has a central web separating said first and second interlocking members.

12. The method as claimed in claim 11 wherein only one of said first and second interlocking members and a part of said central web is attached to said thermoplastic film so that said reclosable packages may have a hinge between said thermoplastic film and said central web.

13. The method as claimed in claim 11 wherein said central web includes an integrally formed tear string.

14. The method as claimed in claim 11 wherein only one of said first and second interlocking members and said central web is attached to said thermoplastic film, so that said reclosable packages may have a hinge between said thermoplastic film and said central web.

15. The method as claimed in claim 11 further comprising the steps of cutting said zipper strip longitudinally through said central web during said step of feeding a continuous supply thereof, and of attaching both of said first and second interlocking members to said thermoplastic film.

16. The method as claimed in claim 1 wherein said zipper strip has a peripheral web along each of said first and second interlocking members.

17. The method as claimed in claim 16 further comprising the steps of cutting said zipper strip longitudinally between said first and second interlocking members during said step of feeding a continuous supply thereof, and of attaching both of said first and second interlocking members and adjacent peripheral webs to said thermoplastic film.

18. The method as claimed in claim 16 further comprising the steps of cutting said zipper strip longitudinally between said first and second interlocking members during said step of feeding a continuous supply thereof, and of attaching both of said first and second interlocking members and a part of one of said adjacent peripheral webs to said thermoplastic film.

19. The method in accordance with claim 1 wherein said forming step is performed at an inwardly tapering lower portion of said filling tube.

20. An apparatus for forming reclosable filled packages comprising:

a filling tube;

means for feeding first and second interlocking members, in a non-interlocked condition, into a position extending parallel to a longitudinal axis of said filling tube;

means for wrapping a thermoplastic film about said filling tube and said interlocking members;

means for sealing longitudinally extending edges of said film to one another whereby to form a plastic tube, said plastic tube encircling said interlocking members and said filling tube;

means for attaching at least one of said interlocking members to said thermoplastic film on an internal surface of said plastic tube;

means for guiding said interlocking members into a facing relationship;

means to urge said interlocking members into an interlocking relationship with one another; and, means to form periodic cross-seams in said plastic tube downstream of said urging means whereby to form individual reclosable packages.

21. The apparatus in accordance with claim 20 further comprising means for guiding a tear string being said filling tube and interlocking members in a space between said interlocking members.

22. The apparatus in accordance with claim 20 further comprising parallel, longitudinally extending grooves disposed on an outer surface of said filling tube and said feeding means feeds said first interlocking member into one of said grooves and said second interlocking member into another of said grooves.

23. The apparatus in accordance with claim 22 wherein said grooves are provided in a curved plate attached to the outside of said filling tube.

24. The apparatus in accordance with claim 20 wherein said filling tube has a funnel shape lower portion which tapers inwardly and said guiding means guides said interlocking members into a facing relationship as said interlocking members pass through a space of increasing width resulting from said inwardly tapering filling tube.

25. The apparatus of claim 20 wherein said means for urging said interlocking members to interlock is disposed downstream of said filling tube.

* * * * *